US010613464B2

(12) United States Patent
Yamaki

(10) Patent No.: US 10,613,464 B2
(45) Date of Patent: Apr. 7, 2020

(54) IMAGE FORMING APPARATUS DETERMINING A FILM SCRAPING AMOUNT OF A PHOTORECEPTOR, METHOD AND PROGRAM FOR CONTROLLING THE APPARATUS

(71) Applicant: Konica Minolta, Inc., Tokyo (JP)

(72) Inventor: Hideo Yamaki, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/152,759

(22) Filed: Oct. 5, 2018

(65) Prior Publication Data

US 2019/0121276 A1 Apr. 25, 2019

(30) Foreign Application Priority Data

Oct. 19, 2017 (JP) ..... 2017-202817

(51) Int. Cl.
*G03G 15/00* (2006.01)
*G03G 21/18* (2006.01)

(52) U.S. Cl.
CPC ..... *G03G 15/553* (2013.01); *G03G 15/5029* (2013.01); *G03G 21/1875* (2013.01); *G03G 2215/00071* (2013.01); *G03G 2221/1663* (2013.01)

(58) Field of Classification Search
CPC ..... G03G 15/553; G03G 21/1875; G03G 2221/1663; G03G 15/5029; G03G 21/1671; G03G 2215/00071
See application file for complete search history.

(56) References Cited

U.S. PATENT DOCUMENTS 5,835,818 A * 11/1998 Hoshika ..... G03G 15/553 399/26
2014/0016953 A1* 1/2014 Yoshida ..... G03G 15/55 399/26

FOREIGN PATENT DOCUMENTS

JP H05188674 A 7/1993
JP H1039691 A 2/1998
JP 2011008120 A * 1/2011

* cited by examiner

*Primary Examiner* — David M. Gray
*Assistant Examiner* — Laura Roth
(74) *Attorney, Agent, or Firm* — Lucas & Mercanti, LLP

(57) ABSTRACT

An image forming apparatus includes a photoreceptor, a measurer that measures the number of rotations of the photoreceptor, and a hardware processor. The hardware processor predicts a film scraping amount of the photoreceptor on the basis of a measurement result of the measurer and determines a service life of the photoreceptor on the basis of a prediction result of the hardware processor. The hardware processor calculates the film scraping amount by multiplying the number of rotations of the photoreceptor per predetermined time by a predetermined coefficient, and integrates the calculated film scraping amount for each predetermined time. The predetermined coefficient is set to a different value according to the number of rotations of the photoreceptor per predetermined time.

14 Claims, 10 Drawing Sheets

| PER HOUR | WEIGHTING COEFFICIENT (FILM SCRAPING μm/knot) | | | |
|---|---|---|---|---|
| JOB / NUMBER OF PRINTED SHEETS | 5 OR LESS | 6 TO 15 | 16 TO 30 | 31 OR MORE |
| 5 SHEETS OR LESS | 1.0 | | | |
| 10 SHEETS OR LESS | 1.1 | 1.0 | | |
| 50 SHEETS OR LESS | 1.2 | 1.1 | 1.0 | |
| 100 SHEETS OR LESS | 1.3 | 1.2 | 1.1 | 1.0 |
| 1,000 SHEETS OR LESS | 1.4 | 1.3 | 1.2 | 1.1 |
| 2,000 SHEETS OR LESS | 1.6 | 1.4 | 1.3 | 1.2 |
| 2,001 SHEETS OR MORE | 2.0 | 1.7 | 1.6 | 1.5 |

| NUMBER OF PRINTED SHEETS PER HOUR | WEIGHTING COEFFICIENT (FILM SCRAPING μm/knot) |
|---|---|
| 5 SHEETS OR LESS | 1.0 |
| 10 SHEETS OR LESS | 1.1 |
| 50 SHEETS OR LESS | 1.2 |
| 100 SHEETS OR LESS | 1.3 |
| 1,000 SHEETS OR LESS | 1.4 |
| 2,000 SHEETS OR LESS | 1.6 |
| 2,001 SHEETS OR MORE | 2.0 |

FIG. 6

| NUMBER OF PRINTED SHEETS PER HOUR | WEIGHTING COEFFICIENT (FILM SCRAPING μm/knot) | | PHOTORECEPTOR ROTATION NUMBER (knot) | | FILM SCRAPING AMOUNT (μm) |
|---|---|---|---|---|---|
| 5 SHEETS OR LESS | 1.0 | × | 200 | = | 2.00 |
| 10 SHEETS OR LESS | 1.1 | × | 250 | = | 2.75 |
| 50 SHEETS OR LESS | 1.2 | × | 200 | = | 2.40 |
| 100 SHEETS OR LESS | 1.3 | × | 150 | = | 1.95 |
| 1,000 SHEETS OR LESS | 1.4 | × | 100 | = | 1.40 |
| 2,000 SHEETS OR LESS | 1.6 | × | 50 | = | 0.80 |
| 2,001 SHEETS OR MORE | 2.0 | × | 50 | = | 1.00 |
| | TOTAL | | 1,000 | | 12.3 |

FIG. 8

| | CURRENT TIME POINT | FUTURE | | | | |
|---|---|---|---|---|---|---|
| FILM SCRAPING SPEED (μm/knot) | 1.23 | FILM SCRAPING SPEED UNCHANGED | 1.23 | FILM SCRAPING SPEED MODIFIED | 1 | 2 |
| WEIGHTING COEFFICIENT (μm) | 12.3 | SERVICE LIFE THRESHOLD VALUE | 20 | SERVICE LIFE THRESHOLD VALUE | 20 | 20 |
| NUMBER OF ROTATIONS | 1,000 | REMAINING NUMBER OF ROTATIONS | 626 | REMAINING NUMBER OF ROTATIONS | 770 | 385 |
| NUMBER OF DAYS | 100 | REMAINING NUMBER OF DAYS | 63 | REMAINING NUMBER OF DAYS | 77 | 39 |

| PER HOUR | WEIGHTING COEFFICIENT (FILM SCRAPING μm/knot) | | | |
|---|---|---|---|---|
| JOB / NUMBER OF PRINTED SHEETS | 5 OR LESS | 6 TO 15 | 16 TO 30 | 31 OR MORE |
| 5 SHEETS OR LESS | 1.0 | | | |
| 10 SHEETS OR LESS | 1.1 | 1.0 | | |
| 50 SHEETS OR LESS | 1.2 | 1.1 | 1.0 | |
| 100 SHEETS OR LESS | 1.3 | 1.2 | 1.1 | 1.0 |
| 1,000 SHEETS OR LESS | 1.4 | 1.3 | 1.2 | 1.1 |
| 2,000 SHEETS OR LESS | 1.6 | 1.4 | 1.3 | 1.2 |
| 2,001 SHEETS OR MORE | 2.0 | 1.7 | 1.6 | 1.5 |

FIG. 11

| PER HOUR | WEIGHTING COEFFICIENT (FILM SCRAPING μm/knot) | | |
|---|---|---|---|
| PAPER TYPE / NUMBER OF PRINTED SHEETS | PLAIN PAPER | THICK PAPER P | THICK PAPER Q |
| 5 SHEETS OR LESS | 1.0 | 1.1 | 1.2 |
| 10 SHEETS OR LESS | 1.1 | 1.2 | 1.3 |
| 50 SHEETS OR LESS | 1.2 | 1.3 | 1.4 |
| 100 SHEETS OR LESS | 1.3 | 1.4 | 1.5 |
| 1,000 SHEETS OR LESS | 1.4 | 1.5 | 1.6 |
| 2,000 SHEETS OR LESS | 1.6 | 1.7 | 1.8 |
| 2,001 SHEETS OR MORE | 2.0 | 2.1 | 2.2 |

FIG. 12

| PER HOUR | WEIGHTING COEFFICIENT (FILM SCRAPING μm/100 knot) | |
|---|---|---|
| JOB / NUMBER OF PRINTED SHEETS | SINGLE-SIDED PRINTING | DOUBLE-SIDED PRINTING |
| 5 SHEETS OR LESS | 1 | 1.25 |
| 10 SHEETS OR LESS | 1.1 | 1.38 |
| 50 SHEETS OR LESS | 1.2 | 1.50 |
| 100 SHEETS OR LESS | 1.3 | 1.63 |
| 1,000 SHEETS OR LESS | 1.4 | 1.75 |
| 2,000 SHEETS OR LESS | 1.6 | 2.00 |
| 2,001 SHEETS OR MORE | 2 | 2.50 |

FIG. 13A

| NUMBER OF PRINTED SHEETS PER HOUR | WEIGHTING COEFFICIENT (FILM SCRAPING μm/knot) | | PHOTORECEPTOR ROTATION NUMBER (knot) | | FILM SCRAPING AMOUNT (μm) |
|---|---|---|---|---|---|
| 5 SHEETS OR LESS | 1.0 | × | 200 | = | 2.00 |
| 10 SHEETS OR LESS | 1.1 | × | 125 | = | 1.38 |
| 50 SHEETS OR LESS | 1.2 | × | 100 | = | 1.20 |
| 100 SHEETS OR LESS | 1.3 | × | 75 | = | 0.98 |
| 1,000 SHEETS OR LESS | 1.4 | × | 50 | = | 0.70 |
| 2,000 SHEETS OR LESS | 1.6 | × | 25 | = | 0.40 |
| 2,001 SHEETS OR MORE | 2.0 | × | 25 | = | 0.50 |
| | TOTAL | | 600 | | 7.15 |

FIG. 13B

| NUMBER OF PRINTED SHEETS PER HOUR | WEIGHTING COEFFICIENT (FILM SCRAPING μm/knot) | | PHOTORECEPTOR ROTATION NUMBER (knot) | | FILM SCRAPING AMOUNT (μm) |
|---|---|---|---|---|---|
| 5 SHEETS OR LESS | 1.3 | × | 100 | = | 1.25 |
| 10 SHEETS OR LESS | 1.4 | × | 70 | = | 0.96 |
| 50 SHEETS OR LESS | 1.5 | × | 70 | = | 1.05 |
| 100 SHEETS OR LESS | 1.6 | × | 75 | = | 1.22 |
| 1,000 SHEETS OR LESS | 1.8 | × | 35 | = | 0.61 |
| 2,000 SHEETS OR LESS | 2.0 | × | 25 | = | 0.50 |
| 2,001 SHEETS OR MORE | 2.5 | × | 25 | = | 0.63 |
| | TOTAL | | 400 | | 6.22 |

IMAGE FORMING APPARATUS DETERMINING A FILM SCRAPING AMOUNT OF A PHOTORECEPTOR, METHOD AND PROGRAM FOR CONTROLLING THE APPARATUS

The entire disclosure of Japanese patent Application No. 2017-202817, filed on Oct. 19, 2017, is incorporated herein by reference in its entirety.

BACKGROUND

Technological Field

The present disclosure relates to an electrophotographic image forming apparatus.

Description of the Related Art

An image forming apparatus using a technique of the electrophotographic process (e.g., printer, copier, facsimile) commonly forms an electrostatic latent image by irradiating (exposing) a charged photoreceptor with laser light based on image data. Then, toner is supplied from a developing device to the photoreceptor on which the electrostatic latent image is formed, whereby the electrostatic latent image is visualized and a toner image is formed. Further, the toner image is directly or indirectly transferred to a paper sheet and heated and pressurized at a fixing nip, whereby the toner image is formed on the paper sheet.

Meanwhile, in recent years, products need to be environment-friendly. As an example thereof, it is required to extend a service life of a replacement part of a product, and to improve prediction accuracy of a replacement timing.

Since a photoreceptor has a comparatively short service life among the replacement parts, it is required to improve the prediction accuracy of the replacement timing.

As a method for detecting the replacement timing of the photoreceptor, there has been known a method for predicting a service life on the basis of an integration time of a rotation time of the photoreceptor as disclosed in JP H05-188674 A1.

Besides, there has been known a method for predicting a service life on the basis of a charging application state together with the rotation time as disclosed in JP H10-039691 A1.

Meanwhile, as the number of printed sheets per unit time increases, the temperature around the photoreceptor inside a machine rises so that resistance of a charging roller decreases. Accordingly, the amount of current flowing to the photoreceptor increases. This increase in the current amount may shorten the service life of the photoreceptor.

SUMMARY

The present disclosure has been conceived to solve the problem described above, and an object of the present disclosure is to provide an image forming apparatus, a method for controlling an image forming apparatus, and a program capable of predicting a service life of a photoreceptor with high accuracy.

To achieve the abovementioned object, according to an aspect of the present invention, an image forming apparatus reflecting one aspect of the present invention comprises: a photoreceptor; a measurer that measures the number of rotations of the photoreceptor; and a hardware processor that predicts a film scraping amount of the photoreceptor on the basis of a measurement result of the measurer, and determines a service life of the photoreceptor on the basis of a prediction result of the hardware processor, wherein the hardware processor calculates the film scraping amount by multiplying the number of rotations of the photoreceptor per predetermined time by a predetermined coefficient, and integrates the calculated film scraping amount for each predetermined time, and the predetermined coefficient is set to a different value according to the number of rotations of the photoreceptor per predetermined time.

BRIEF DESCRIPTION OF THE DRAWINGS

The objects, advantages, aspects, and features provided by one or more embodiments of the invention will become more fully understood from the detailed description given hereinbelow and the appended drawings which are given by way of illustration only, and thus are not intended as a definition of the limits of the present invention:

FIG. 6 is a diagram illustrating a method for calculating a film scraping amount using a predictor according to the embodiment;

FIG. 8 is a table illustrating a prediction result of a service life using a determiner according to the embodiment;

FIG. 11 is a diagram illustrating a weighting table according to Variation 2 of the embodiment;

FIG. 12 is a diagram illustrating a weighting table according to Variation 3 of the embodiment; and FIGS. 13A and 13B are diagrams illustrating a method for calculating a film scraping amount using a predictor according to Variation 3 of the embodiment.

DETAILED DESCRIPTION OF EMBODIMENTS

Figure 1:
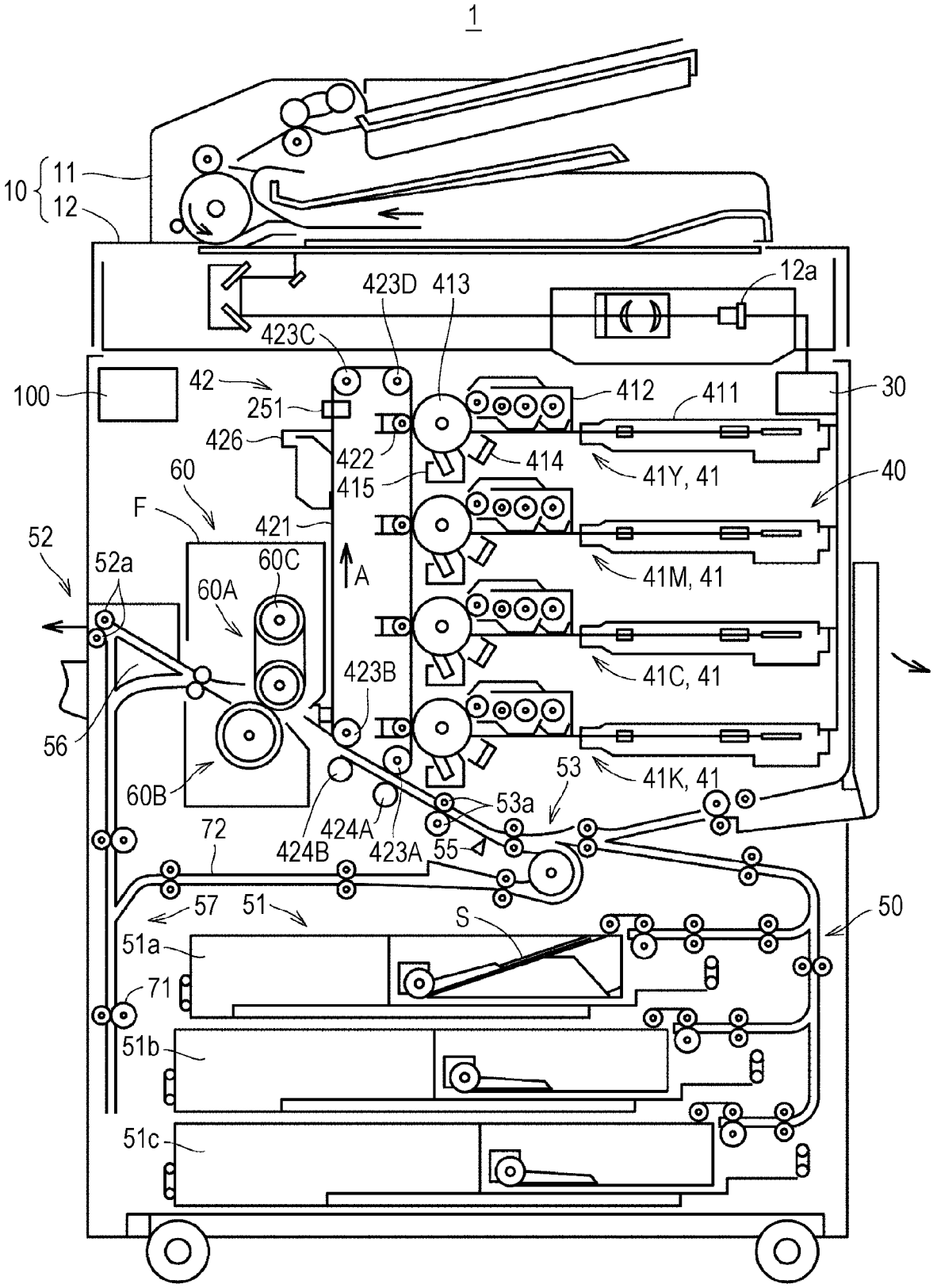
FIG. 1 is a diagram schematically illustrating an overall configuration of an image forming apparatus according to an embodiment.

Hereinafter, one or more embodiments of the present invention will be described with reference to the drawings. However, the scope of the invention is not limited to the disclosed embodiments. The same constituent elements are denoted by the same reference numerals in the following descriptions. Names and functions thereof are also the same. Detailed descriptions thereof will not be repeated, accordingly. Note that each embodiment and each variation to be described below may be selectively combined as appropriate.

In the following embodiment, examples of an image forming apparatus include an MFP, a printer, a copier, and a facsimile.

FIG. 1 is a diagram schematically illustrating an overall configuration of an image forming apparatus 1 according to an embodiment.

Figure 2:
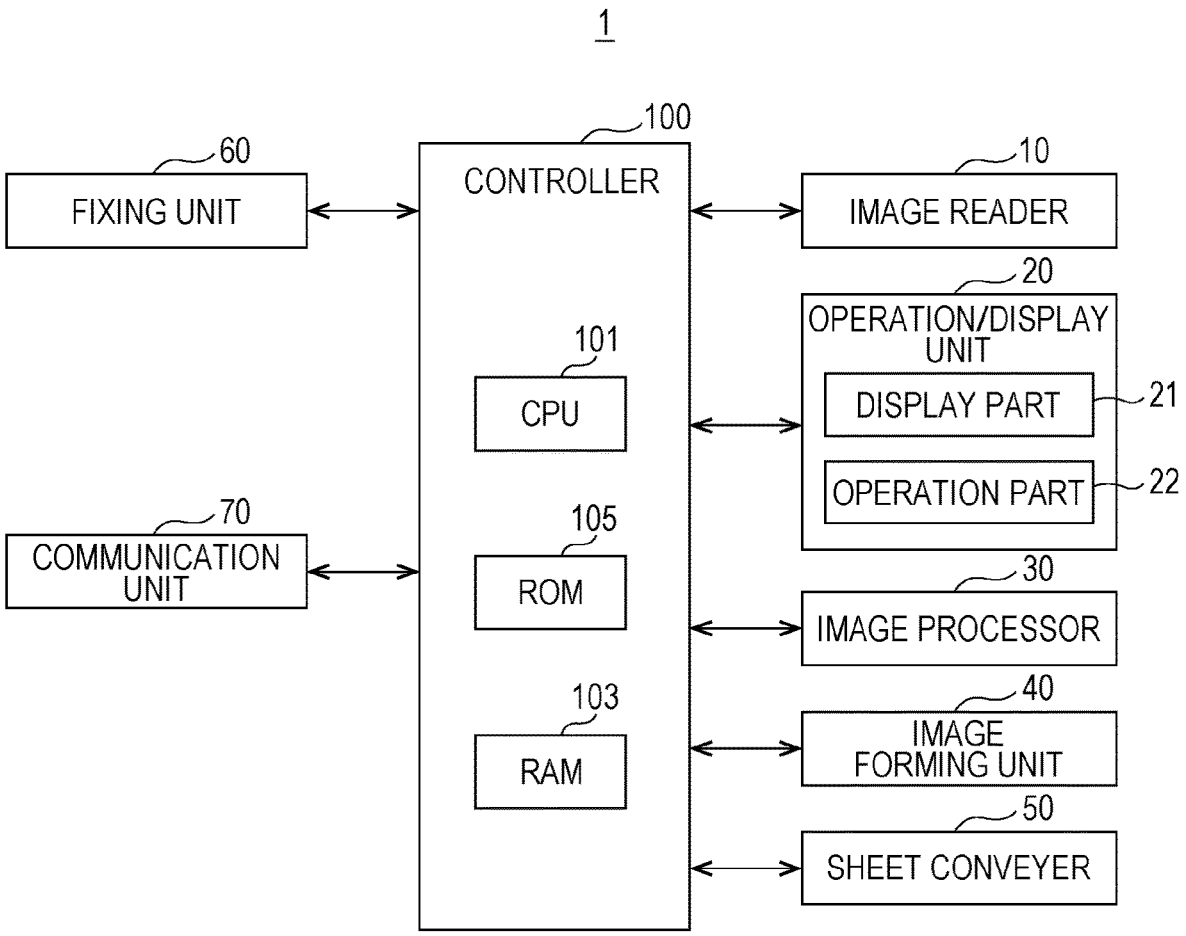
FIG. 2 is a diagram illustrating a main part of a control system of the image forming apparatus according to the embodiment.

FIG. 2 is a diagram illustrating a main part of a control system of the image forming apparatus 1 according to the embodiment.

The image forming apparatus 1 illustrated in FIGS. 1 and 2 is a color image forming apparatus of an intermediate transfer type using a technique of the electrophotographic process. That is, the image forming apparatus 1 transfers toner images of respective colors yellow (Y), magenta (M), cyan (C), and black (K) formed on photoreceptors 413 onto an intermediate transfer belt 421 (primary transfer), superimposes the toner images of the four colors on the intermediate transfer belt 421, and then transfers the toner image onto a paper sheet S (secondary transfer), thereby forming an image.

In addition, the image forming apparatus 1 employs a tandem system in which the photoreceptors 413 corresponding to the respective four colors Y, M, C, and K are disposed in series in the running direction of the intermediate transfer belt 421, and the toner images of the respective colors are successively transferred to the intermediate transfer belt 421 in a single procedure.

As illustrated in FIG. 2, the image forming apparatus 1 includes an image reader 10, an operation/display unit 20, an image processor 30, an image former 40, a sheet conveyer 50, a fixing unit 60, a communication unit 70, and a controller 100.

The controller 100 includes a central processing unit (CPU) 101, a read-only memory (ROM) 102, a random access memory (RAM) 103, and the like. The CPU 101 reads, from the ROM 102, a program corresponding to processing details, loads the program into the RAM 103, and performs, in cooperation with the loaded program, centralized control on operations of respective blocks of the image forming apparatus 1.

The ROM 102 and the RAM 103 include, for example, a nonvolatile semiconductor memory (what is called flash memory), and/or a hard disk drive.

The controller 100 transmits/receives various data to/from an external device (e.g., personal computer) connected to a communication network such as a local area network (LAN) and a wide area network (WAN) via the communication unit 70. For example, the controller 100 receives image data transmitted from the external device, and operates to form an image on the paper sheet S on the basis of the image data (input image data). The communication unit 70 includes, for example, a network interface card such as a LAN card.

The image reader 10 includes an auto document feeder (ADF) 11, a document image scanner 12, and the like.

The auto document feeder 11 conveys, with a conveying mechanism, a document D placed on a document tray and sends it to the document image scanner 12. The auto document feeder 11 can continuously and simultaneously read images on multiple documents D (including images on both sides thereof) placed on the document tray.

The document image scanner 12 optically scans a document conveyed from the auto document feeder 11 onto a contact glass or a document placed on a contact glass, and images light reflected from the document on a light receiving surface of a charge coupled device (CCD) sensor 12*a*, thereby reading a document image. The image reader 10 generates input image data on the basis of a result of the reading performed by the document image scanner 12. The input image data is subject to predetermined image processing in the image processor 30.

The operation/display unit 20 includes, for example, a touch panel-type liquid crystal display (LCD), and functions as a display part 21 and an operation part 22. The display part 21 displays various operation screens, image conditions, operation conditions of each function, and the like in accordance with a display control signal input from the controller 100. The operation part 22 includes various operation keys such as a numeric keypad and a start key, receives various input operations from a user, and outputs an operation signal to the controller 100.

The image processor 30 includes, for example, a circuit that performs digital image processing on input image data in accordance with default settings or user settings. For example, the image processor 30 performs tone correction on the basis of tone correction data (tone correction table) under the control of the controller 100. In addition to the tone correction, the image processor 30 also performs, on the input image data, various correction processing such as color correction and shading correction, compression processing, and the like. The image former 40 is controlled on the basis of the processed image data.

The image former 40 includes, for example, an intermediate transfer unit 42 and image forming units 41Y, 41M, 41C, and 41K for forming images with color toners of respective Y, M, C, and K components on the basis of the input image data.

The image forming units 41Y, 41M, 41C, and 41K for respective Y, M, C, and K components have similar configurations. For convenience in illustration and description, common components are denoted by the same numerals, and such numerals are accompanied by Y, M, C, or K when they are to be distinguished. In FIG. 1, only constituent elements of the image forming unit 41Y for the Y component are denoted by numerals, and numerals for constituent elements of other image forming units 41M, 41C, and 41K are omitted.

The image forming unit 41 includes an exposing device 411, a developing device 412, the photoreceptor 413, a charging device 414, a drum cleaning device 415, and the like.

The photoreceptor 413 is, for example, a negative-charging organic photoconductor (OPC) formed by successively laminating, on a peripheral surface of aluminum conductive cylinder (aluminum tube) having a drum diameter of 80 mm, an undercoat layer (UCL), a charge generation layer (CGL), and a charge transport layer (CU). The charge generation layer is formed from an organic semiconductor composed of a charge generation material (e.g., phthalocyanine pigment) dispersed in a resin binder (e.g., polycarbonate), and generates pairs of positive charges and negative charges upon exposure using the exposing device 411. The charge transport layer is formed from a hole transport material (electron-donating nitrogen compound) dispersed in a resin binder (e.g., polycarbonate resin), and transports positive charges generated in the charge generation layer to a surface of the charge transport layer.

The controller 100 controls driving current supplied to a driving motor (not illustrated) that rotates the photoreceptor 413, whereby the photoreceptor 413 rotates at a constant peripheral speed.

The charging device 414 evenly and negatively charges the surface of the photoconductive photoreceptor 413. For example, a charging roller or the like may be used.

The exposing device 411 includes, for example, a semiconductor laser, and irradiates the photoreceptor 413 with laser light corresponding to an image of each color component. Positive charges are generated in the charge generation layer of the photoreceptor 413, and transported to the surface of the charge transport layer, thereby neutralizing surface charges (negative charges) of the photoreceptor 413. Electrostatic latent images of respective color components are formed on the surface of the photoreceptor 413, respectively, due to potential differences from the surroundings.

The developing device 412 is, for example, a developing device of a two-component developing system, and forms a toner image by attaching a toner (oilless toner including wax in toner particles) of each color component to the surface of each photoreceptor 413 to visualize the electrostatic latent image.

The drum cleaning device 415 includes a drum cleaning blade and the like to be in sliding contact with the surface of the photoreceptor 413, and removes residual toner remaining on the surface of the photoreceptor 413 after the primary transfer.

The intermediate transfer unit 42 includes the intermediate transfer belt 421, a primary transfer roller 422, a plurality of support rollers 423, a secondary transfer roller 424, a belt cleaning device 426, and the like.

The intermediate transfer belt 421 includes an endless belt, and looped around the plurality of support rollers 423 under tension. At least one of the plurality of support rollers 423 is a driving roller, and the rest are driven rollers. For example, a roller 423A disposed downstream of the primary transfer roller 422 for the K component in the belt running direction is preferably a driving roller. This facilitates the retention of a constant running speed of the belt in a primary transfer section. The intermediate transfer belt 421 runs at a constant speed in the direction of an arrow A by the driving roller 423A being rotated.

The primary transfer roller 422 is disposed facing the photoreceptor 413 for each color component on the inner peripheral surface side of the intermediate transfer belt 421. The primary transfer roller 422 is firmly pressed against the photoreceptor 413 with the intermediate transfer belt 421 interposed therebetween, whereby a primary transfer nip for transferring a toner image from the photoreceptor 413 to the intermediate transfer belt 421 is formed.

The secondary transfer rollers 424A and 424B are disposed on the outer peripheral surface side of the intermediate transfer belt 421 while facing driving rollers 423A and 423B disposed downstream in the running direction of the belt. The secondary transfer rollers 424A and 424B are firmly pressed against the driving rollers 423A and 424B with the intermediate transfer belt 421 interposed therebetween, whereby a secondary transfer nip for transferring a toner image from the intermediate transfer belt 421 to the paper sheet S is formed.

When the intermediate transfer belt 421 passes through the primary transfer nip, toner images on the photoreceptors 413 are successively superimposed and transferred to the intermediate transfer belt 421 (primary transfer). Specifically, primary transfer bias is applied to the primary transfer roller 422 to impart a charge with polarity opposite to that of toners to the rear surface side of the intermediate transfer belt 421 (side in contact with the primary transfer roller 422), thereby electrostatically transferring the toner image to the intermediate transfer belt 421.

Subsequently, when the paper sheet S passes through the secondary transfer nip, the toner image on the intermediate transfer belt 421 is transferred to the paper sheet S (secondary transfer). Specifically, secondary transfer bias is applied to the secondary transfer rollers 424A and 424B to impart a charge with polarity opposite to that of toners to the rear surface side of the paper sheet S (side in contact with the secondary transfer roller 424), thereby electrostatically transferring the toner image to the paper sheet S. The paper sheet S bearing the transferred toner image is conveyed to the fixing unit 60.

The belt cleaning part 426 includes a belt cleaning blade and the like to be in sliding contact with the surface of the intermediate transfer belt 421, and removes residual toner remaining on the surface of the intermediate transfer belt 421 after the secondary transfer.

The fixing unit 60 includes a fixing member 60A having a fixing surface side member, which is disposed on the fixing surface (surface on which the toner image is formed) side of the paper sheet S, a pressurization member 60B having a rear surface side support member, which is disposed on the rear surface (surface opposite to the fixing surface) side of the paper sheet S, a heat source 60C, and the like. The rear surface side support member is firmly pressed against the fixing surface side member, thereby forming the fixing nip that grips and conveys the paper sheet S.

The fixing unit 60 heats and presses the conveyed paper sheet S on which the toner image has been transferred (secondary transfer) at the fixing nip, thereby fixing the toner image on the paper sheet S. The fixing unit 60 is disposed inside a fixing device F as a unit. In addition, the fixing device F may be provided with an air separation unit that separates the paper sheet S from the fixing surface side member or the rear surface side support member by blowing air. Details of the fixing unit 60 will be described later.

The sheet conveyer 50 is controlled in accordance with an instruction from the controller 100.

The sheet conveyer 50 includes a sheet feeder 51, a sheet ejector 52, a sheet re-feeder 57, a conveying path 53, and the like. Three sheet feeding tray units 51*a* to 51*c* included in the sheet feeder 51 store the paper sheets S (standard paper sheets and special paper sheets) classified on the basis of basis weight, size, and the like in accordance with predetermined types. The conveying path 53 includes a plurality of pairs of conveying rollers such as a registration roller pair 53*a*.

The paper sheets S stored in the sheet feeding tray units 51*a* to 51*c* are sent out from the topmost part one by one, and conveyed to the image former 40 through the conveying path 53. During this step, a registration roller section in which the registration roller pair 53*a* is disposed corrects the tilt of the paper sheet S fed and adjusts the timing of conveyance. The toner image on the intermediate transfer belt 421 is then simultaneously transferred to one of the surfaces of the paper sheet S in the image former 40 (secondary transfer), and a fixing step is performed in the fixing unit 60. The paper sheet S bearing the formed image is ejected outside the apparatus by the sheet ejector 52 provided with a sheet ejection roller 52*a*.

In a case where the image formation is also performed on the rear surface of the paper sheet S, the paper sheet S on which an image has been fixed on the front surface is conveyed to the sheet re-feeder 57 provided below a sheet guide member 56.

The sheet re-feeder 57 includes a sheet re-feed reversing roller 71.

The sheet re-feed reversing roller 71 nips the back end of the paper sheet S, reversely conveys it to invert the paper sheet S, and sends the paper sheet S to a sheet re-feed conveying path 72. The paper sheet S is again sent to the conveying path 53 from the sheet re-feed conveying path 72. The paper sheet S is then conveyed to the image former 40 through the conveying path 53. Subsequently, the toner image is transferred to the rear surface of the paper sheet S (secondary transfer) in the image former 40, and the fixing step is performed in the fixing unit 60. The paper sheet S bearing the formed image on both sides thereof is ejected outside the apparatus by the sheet ejector 52 provided with the sheet ejection roller 52*a*.

[Prediction of Service Life of Photoreceptor 413]

In general, a film thickness is used as an index of service life prediction with respect to the photoreceptor 413. As the film thickness of the photoreceptor 413 decreases, it becomes difficult to maintain chargeability of surface potential and attenuation during exposure. Therefore, when the film thickness has worn to become equal to or less than a predetermined value, it is determined that the photoreceptor 413 has reached the end of its service life.

An element that wears the film thickness of the photoreceptor 413 is a cleaning blade, and current flowing during charging contributes to acceleration of the wear.

In particular, when an AC voltage of a charging roller system or the like is applied, a large amount of current flows in the photoreceptor 413, which accelerates film scraping.

In the present embodiment, a case where the service life ends when it is reduced by 20 μm from an initial value will be exemplified. Therefore, it is assumed that 20 μm is a limit wear amount.

Figure 3:
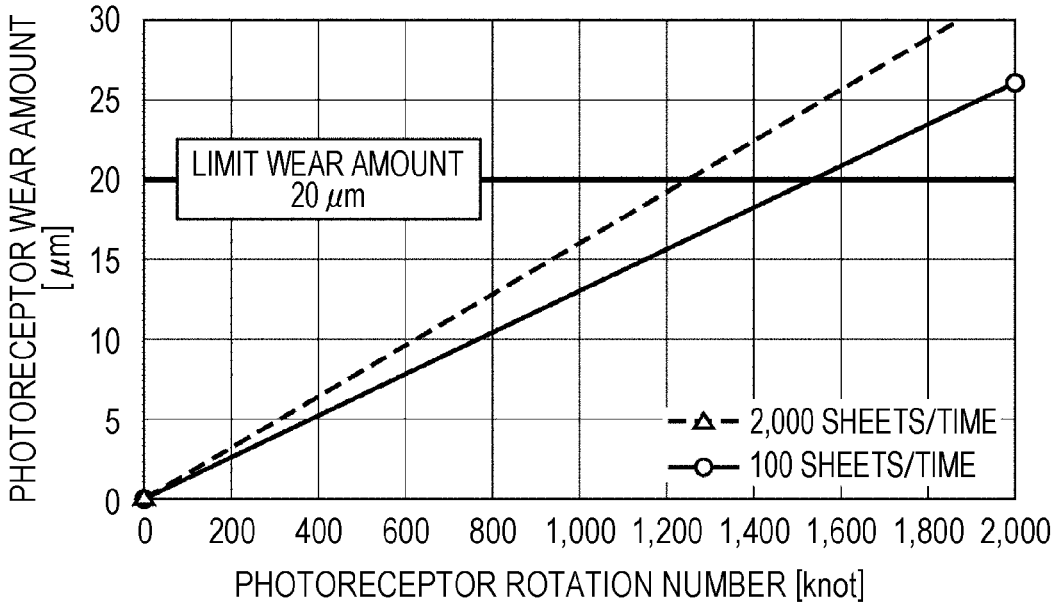
FIG. 3 is a chart illustrating a relationship between the number of rotations of a photoreceptor and a photoreceptor wear amount according to the embodiment.

FIG. 3 is a chart illustrating a relationship between the number of rotations of the photoreceptor 413 and a photoreceptor wear amount according to the embodiment.

In FIG. 3, there is illustrated a case where the photoreceptor wear amount (film scraping amount) linearly increases as the number of rotations of the photoreceptor 413 increases. In addition, there is illustrated a case where the number of printed sheets per unit time is differentiated.

Specifically, there are illustrated a photoreceptor wear amount with respect to the number of rotations of the photoreceptor 413 in a case where the number of printed sheets per unit time is 2,000, and a photoreceptor wear amount with respect to the number of rotations of the photoreceptor 413 in a case where the number of printed sheets per unit time is 100.

In this case, even when the number of rotations of the photoreceptor 413 is the same, the more the number of printed sheets per unit time becomes, the larger the photoreceptor wear amount becomes.

The difference in this manner of scraping is caused by the fact that, for example, a fixing device serves as a heat source when a large number of continuous printings are executed so that the temperature inside the machine gradually increases and resistance of the charging roller decreases, which allows a large amount of current to flow in the photoreceptor 413. When the number of printed sheets is small, a period of time during which the fixing device is turned on is reduced, and the temperature rise is smaller than that in the case of continuous printing.

In the embodiment, a coefficient for calculating the photoreceptor wear amount (film scraping amount) is adjusted in accordance with the number of printed sheets per unit time. Further, the film scraping amount per unit time is integrated to determine the service life of the photoreceptor 413.

Hereinafter, details will be described.

In the present example, a case where the service life of the photoreceptor 413 is determined using the number of rotations of the photoreceptor 413 counted as a parameter will be described.

Figures 4, 5:
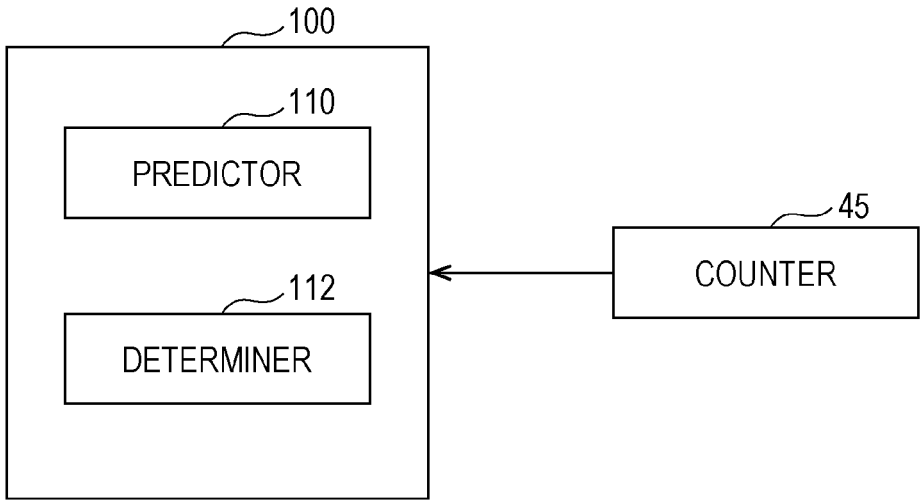
FIG. 4 is a diagram illustrating a weighting table according to the embodiment.
FIG. 5 is a functional block diagram of a controller according to the embodiment.

FIG. 4 is a diagram illustrating a weighting table according to the embodiment.

As illustrated in FIG. 4, weighting coefficients are set according to the respective numbers of printed sheets per unit time. The weighting table may be stored in a ROM 105 or a RAM 103.

In the present example, seven different weightings are set corresponding to the number of printed sheets.

Specifically, the weighting coefficient is set to "1.0" in the case of one sheet or more and five sheets or less, the weighting coefficient is set to "1.1" in the case of six sheets or more and ten sheets or less, the weighting coefficient is set to "1.2" in the case of 11 sheets or more and 50 sheets or less, the weighting coefficient is set to "1.3" in the case of 51 sheets or more and 100 sheets or less, the weighting coefficient is set to "1.4" in the case of 101 sheets or more and 1,000 sheets or less, the weighting coefficient is set to "1.6" in the case of 1,001 sheets or more and 2,000 sheets or less, and the weighting coefficient is set to "2.0" in the case of 2,001 sheets or more.

Since the temperature tends to rise as the number of printed sheets increases, the weighting coefficient is set to increase.

Although a method of calculation using the number of printed sheets per unit time is described in the present example, it is not limited to one hour as a unit time, and can be set at predetermined time intervals. Further, accuracy may be improved by delimiting the time interval in less than one hour.

FIG. 5 is a functional block diagram of the controller 100 according to the embodiment.

As illustrated in FIG. 5, the controller 100 includes a predictor 110 and a determiner 112.

Further, there is provided a counter 45 that counts the number of rotations with respect to the photoreceptor 413.

The predictor 110 predicts the film scraping amount of the photoreceptor 413 on the basis of the number of rotations of the photoreceptor 413 input from the counter 45. The predictor 110 predicts the film scraping amount on the basis of the number of rotations of the photoreceptor 413 and the weighting table illustrated in FIG. 4.

The determiner 112 determines the service life of the photoreceptor 413 on the basis of the predicted film scraping amount.

The counter 45 is reset when the photoreceptor 413 is replaced, and continues to count up unless it is replaced.

FIG. 6 is a diagram illustrating a method for calculating the film scraping amount using the predictor 110 according to the embodiment.

As illustrated in FIG. 6, in this case, the number of rotations of the photoreceptor 413 from an initial state (reset) to a current time point is 1,000 knot.

The rotational number data of the photoreceptor 413 obtained from the counter 45 is stratified into seven classifications according to the number of printed sheets per hour, thereby obtaining the number of rotations of the photoreceptor 413 for each of the seven classifications.

The number of rotations is multiplied by each of the seven weighting coefficients to calculate the film scraping amount for each classification.

Subsequently, the film scraping amounts for respective classifications are totaled.

In the present example, a case where the number of rotations of the photoreceptor 413 is 1,000 knot and the film scraping amount 12.3 μm is calculated is illustrated.

Since the limit wear amount is set to 20 μm, at this stage, the determiner 112 determines that the service life of the photoreceptor 413 is not reached.

Figure 7:
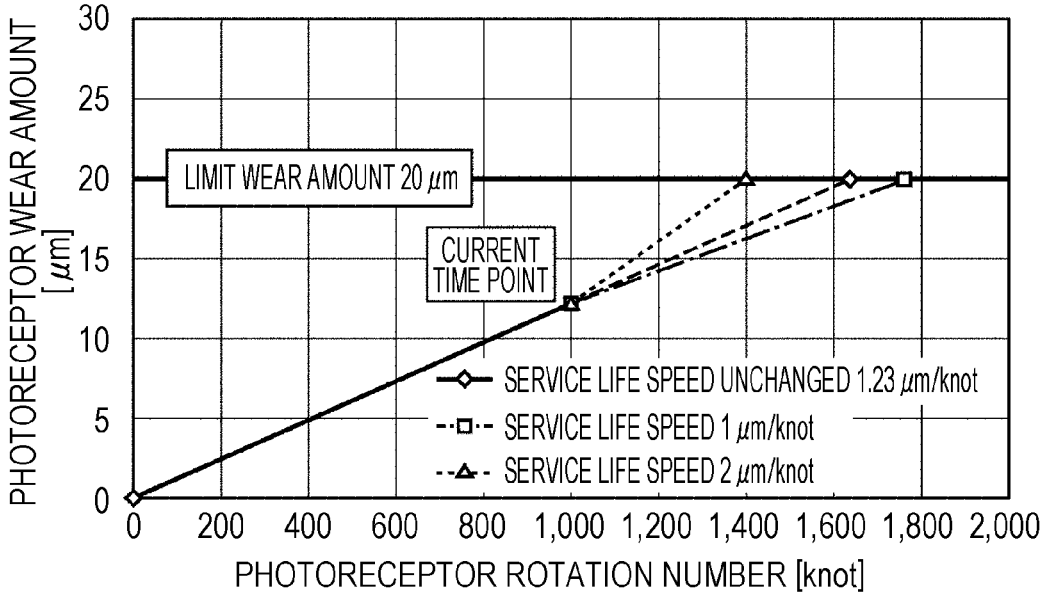
FIG. 7 is a chart illustrating prediction of a service life according to the embodiment.

FIG. 7 is a chart illustrating the prediction of the service life according to the embodiment.

The determiner 112 is capable of calculating the film scraping speed on the basis of the calculation result in FIG. 6. Specifically, it can be calculated as 1.23 μm/knot.

In FIG. 7, a prediction line of the service life of a case where the photoreceptor 413 rotates at the film scraping speed mentioned above is illustrated.

The determiner 112 also executes prediction of the service life of the photoreceptor 413.

The determiner 112 calculates that the limit wear amount 20 μm is reached when the number of rotations is 1,626 knot.

Since the service life of the photoreceptor 413 ends when the number of rotations is 1,626 knot, the remaining number of rotations is 626 knot.

In a case where the determiner 112 determines that 100 days have been required to reach 1,000 knot, it is possible to predict that the photoreceptor 413 will reach the end of its service life 63 days later.

As a timing of the prediction, the prediction may be executed when a power source is turned on, every predetermined number of sheets, every predetermined time interval, at a timing of replacing other elements, and the like.

The determiner 112 may display, on the display part 21, the prediction result calculated at the timing of the prediction mentioned above.

FIG. 8 is a table illustrating the prediction result of the service life using the determiner 112 according to the embodiment.

As illustrated in FIG. 8, in a case where the film scraping speed is unchanged, it is predicted that the service life will end 63 days later.

Meanwhile, there may be a case where the film scraping speed is changed.

For example, it is assumed that the film scraping speed measured one day later from the current time point is 1.0 μm/knot.

The film scraping speed up to the current time point 1.23 μm is corrected, and the remaining number of rotations is calculated as 770 knot by the formula $7.7\times100\div1.0=770$.

It is possible to estimate that the film scraping speed is lowered compared to that up to the current time point and the remaining number of days is 77 days.

Similarly, it is assumed that the film scraping speed measured one day later from the current time point is 2.0 μm/knot.

The film scraping speed up to the current time point 1.23 μm is corrected, and the remaining number of rotations is calculated as 385 knot.

It is possible to estimate that the film scraping speed is accelerated compared to that of the current time point and the remaining number of days is 39 days. Using this method, an expected date on which the service life ends is corrected on a daily basis, whereby the accuracy can be further improved.

(Variation 1)

Figures 9, 10:
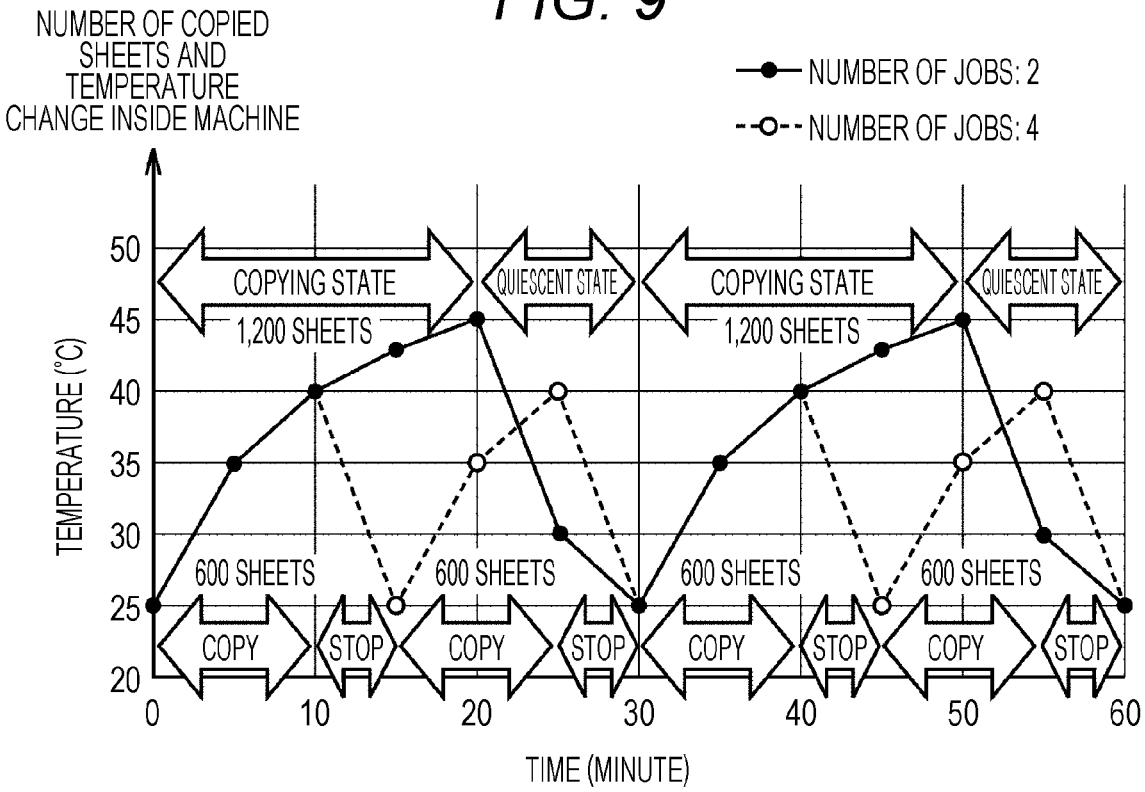
FIG. 9 is a chart illustrating a change in the number of copied sheets and temperature inside a machine according to Variation 1 of the embodiment.
FIG. 10 is a diagram illustrating a weighting table according to Variation 1 of the embodiment.

FIG. 9 is a chart illustrating a change in the number of copied sheets and temperature inside a machine according to Variation 1 of the embodiment.

As illustrated in FIG. 9, even when a miming distance of a photoreceptor 413 and the number of sheets per unit time are the same, the rise of the temperature inside the machine may become larger as the number of jobs becomes smaller.

In the present example, a case where the number of jobs is four and a case where the number of jobs is two are illustrated.

In a case where the number of printed sheets is 2,400 sheets, the rise of the temperature inside the machine differs between the case of printing divided into two jobs and the case of printing divided into four jobs.

FIG. 10 is a diagram illustrating a weighting table according to Variation 1 of the embodiment.

As illustrated in FIG. 10, in the present example, seven different weightings are set corresponding to the number of printed sheets. The weighting table may be stored in a ROM 105 or a RAM 103.

Specifically, the weighting is set according to the number of printed sheets and the number of jobs.

For example, when the number of jobs is five or less, a weighting coefficient is set to "1.0" in the case where the number of printed sheets is one sheet or more and five sheets or less, the weighting coefficient is set to "1.1" in the case of six sheets or more and ten sheets or less, the weighting coefficient is set to "1.2" in the case of 11 sheets or more and 50 sheets or less, the weighting coefficient is set to "1.3" in the case of 51 sheets or more and 100 sheets or less, the weighting coefficient is set to "1.4" in the case of 101 sheets or more and 1,000 sheets or less, the weighting coefficient is set to "1.6" in the case of 1,001 sheets or more and 2,000 sheets or less, and the weighting coefficient is set to "2.0" in the case of 2,001 sheets or more.

When the number of jobs is six or more and 15 or less, the weighting coefficient is set to "1.0" in the case where the number of printed sheets is one sheet or more and nine sheets or less, the weighting coefficient is set to "1.1" in the case of 11 sheets or more and 50 sheets or less, the weighting coefficient is set to "1.2" in the case of 51 sheets or more and 100 sheets or less, the weighting coefficient is set to "1.3" in the case of 101 sheets or more and 1,000 sheets or less, the weighting coefficient is set to "1.4" in the case of 1,001 sheets or more and 2,000 sheets or less, and the weighting coefficient is set to "1.7" in the case of 2,001 sheets or more.

When the number of jobs is 16 or more and 30 or less, the weighting coefficient is set to "1.0" in the case where the number of printed sheets is one sheet or more and 50 sheets or less, the weighting coefficient is set to "1.1" in the case of 51 sheets or more and 100 sheets or less, the weighting coefficient is set to "1.2" in the case of 101 sheets or more and 1,000 sheets or less, the weighting coefficient is set to "1.3" in the case of 1,001 sheets or more and 2,000 sheets or less, and the weighting coefficient is set to "1.6" in the case of 2,001 sheets or more.

When the number of jobs is 31 or more, the weighting coefficient is set to "1.0" in the case where the number of printed sheets is one sheet or more and 100 sheets or less, the weighting coefficient is set to "1.1" in the case of 101 sheets or more and 1,000 sheets or less, the weighting coefficient is set to "1.2" in the case of 1,001 sheets or more and 2,000 sheets or less, and the weighting coefficient is set to "1.5" in the case of 2,001 sheets or more.

Since the temperature tends to rise as the number of jobs is small relative to the number of printed sheets, the weighting coefficient is set to increase.

In Variation 1 of the embodiment as well, a coefficient for calculating a film scraping amount is adjusted according to the number of printed sheets and the number of jobs per unit time in accordance with the method similar to that described above. Further, the film scraping amount per unit time is integrated to determine the service life of the photoreceptor 413.

In this manner, the service life of the photoreceptor can be predicted with high accuracy.

(Variation 2)

FIG. 11 is a diagram illustrating a weighting table according to Variation 2 of the embodiment.

As illustrated in FIG. 11, in the present example, seven different weightings are set corresponding to the number of printed sheets. The weighting table may be stored in a ROM 105 or a RAM 103.

Specifically, the weighting is set according to the number of printed sheets and a paper sheet.

In the present example, three types of paper sheets are illustrated. A plain paper, a thick paper P, and a thick paper Q are illustrated. The thick paper P has a thickness or a basis weight larger than that of the plain paper.

The thick paper Q has a thickness or a basis weight larger than that of the thick paper P.

For example, when the paper sheet is the "plain paper", a weighting coefficient is set to "1.0" in the case where the number of printed sheets is one sheet or more and five sheets or less, the weighting coefficient is set to "1.1" in the case of six sheets or more and ten sheets or less, the weighting coefficient is set to "1.2" in the case of 11 sheets or more and 50 sheets or less, the weighting coefficient is set to "1.3" in the case of 51 sheets or more and 100 sheets or less, the weighting coefficient is set to "1.4" in the case of 101 sheets or more and 1,000 sheets or less, the weighting coefficient is set to "1.6" in the case of 1,001 sheets or more and 2,000 sheets or less, and the weighting coefficient is set to "2.0" in the case of 2,001 sheets or more.

When the paper sheet is the "thick paper P", the weighting coefficient is set to "1.1" in the case where the number of printed sheets is one sheet or more and five sheets or less, the weighting coefficient is set to "1.2" in the case of six sheets or more and ten sheets or less, the weighting coefficient is set to "1.3" in the case of 11 sheets or more and 50 sheets or less, the weighting coefficient is set to "1.4" in the case of 51 sheets or more and 100 sheets or less, the weighting coefficient is set to "1.5" in the case of 101 sheets or more and 1,000 sheets or less, the weighting coefficient is set to "1.7" in the case of 1,001 sheets or more and 2,000 sheets or less, and the weighting coefficient is set to "2.1" in the case of 2,001 sheets or more.

When the paper sheet is the "thick paper Q", the weighting coefficient is set to "1.2" in the case where the number of printed sheets is one sheet or more and five sheets or less, the weighting coefficient is set to "1.3" in the case of six sheets or more and ten sheets or less, the weighting coefficient is set to "1.4" in the case of 11 sheets or more and 50 sheets or less, the weighting coefficient is set to "1.5" in the case of 51 sheets or more and 100 sheets or less, the weighting coefficient is set to "1.6" in the case of 101 sheets or more and 1,000 sheets or less, the weighting coefficient is set to "1.8" in the case of 1,001 sheets or more and 2,000 sheets or less, and the weighting coefficient is set to "2.2" in the case of 2,001 sheets or more.

A fixing temperature varies depending on the thickness of the paper sheet in order to maintain the fixing property. Accordingly, a rise of a temperature inside a machine differs depending on the paper type (thickness and basis weight).

Since the temperature tends to rise as the thickness and the basis weight increase relative to the number of printed sheets, the weighting is set to increase.

In Variation 2 of the embodiment as well, a coefficient for calculating a film scraping amount is adjusted according to the paper sheet for printing and the number of printed sheets per unit time in accordance with the method similar to that described above. Further, the film scraping amount per unit time is integrated to determine the service life of the photoreceptor 413.

In this manner, the service life of the photoreceptor can be predicted with high accuracy.

(Variation 3)

FIG. 12 is a diagram illustrating a weighting table according to Variation 3 of the embodiment.

In FIG. 12, there is illustrated a case where weightings are set for a single-sided printing and a double-sided printing, respectively. The weighting table may be stored in a ROM 105 or a RAM 103.

For example, when the "single-sided printing" is performed, a weighting coefficient is set to "1.0" in the case where the number of printed sheets is one sheet or more and five sheets or less, the weighting coefficient is set to "1.1" in the case of six sheets or more and ten sheets or less, the weighting coefficient is set to "1.2" in the case of 11 sheets or more and 50 sheets or less, the weighting coefficient is set to "1.3" in the case of 51 sheets or more and 100 sheets or less, the weighting coefficient is set to "1.4" in the case of 101 sheets or more and 1,000 sheets or less, the weighting coefficient is set to "1.6" in the case of 1,001 sheets or more and 2,000 sheets or less, and the weighting coefficient is set to "2.0" in the case of 2,001 sheets or more.

When the "double-sided printing" is performed, the weighting coefficient is set to "1.25" in the case where the number of printed sheets is one sheet or more and five sheets or less, the weighting coefficient is set to "1.38" in the case of six sheets or more and ten sheets or less, the weighting coefficient is set to "1.50" in the case of 11 sheets or more and 50 sheets or less, the weighting coefficient is set to "1.63" in the case of 51 sheets or more and 100 sheets or less, the weighting coefficient is set to "1.75" in the case of 101 sheets or more and 1,000 sheets or less, the weighting coefficient is set to "2.00" in the case of 1,001 sheets or more and 2,000 sheets or less, and the weighting coefficient is set to "2.50" in the case of 2,001 sheets or more.

In the case of the single-sided printing, a paper sheet with heat associated with fixing is directly ejected outside a machine.

Meanwhile, in the case of the double-sided printing, a paper sheet with heat enters the machine again.

Therefore, in the case of the double-sided printing, a rise of a temperature inside the machine becomes large. The weighting coefficient is differentiated between the single-sided printing and the double-sided printing, accordingly.

In the double-sided printing, the weighting is set to increase relative to the number of printed sheets compared to the single-sided printing.

FIGS. 13A and 13B are diagrams illustrating a method for calculating a film scraping amount using a predictor 110 according to Variation 3 of the embodiment.

As illustrated in FIGS. 13A and 13B, in this case, the number of rotations of a photoreceptor 413 from an initial state (reset) to a current time point is 1,000 knot.

FIG. 13A illustrates a method for calculating a film scraping amount in the single-sided printing.

FIG. 13B illustrates a method for calculating a film scraping amount in the double-sided printing.

As an example, the total number of rotations of the photoreceptor 413 is 1,000 knot, and the number of rotations at the time of the single-sided printing is 600 knot. The number of rotations at the time of the double-sided printing is 400 knot.

The number of rotations of the photoreceptor per unit time is stratified into seven classifications with respect to each of the single-sided printing and the double-sided printing. The film scraping amount at the time of the single-sided printing is calculated as 7.15 μm according to the method similar to that illustrated in FIG. 6. The film scraping amount at the time of the double-sided printing is calculated as 6.22 μm. Here, the values illustrated in FIG. 12 are used as the weighting coefficient.

Therefore, the total film scraping amount is calculated as 13.37 μm.

Since a limit wear amount is set to 20 μm, at this stage, a determiner 112 determines that the service life of the photoreceptor 413 is not reached.

The determiner 112 is capable of calculating a film scraping speed on the basis of the calculation result described above. Specifically, it can be calculated as 1.34 μm/knot.

Further, the determiner 112 is also capable of predicting the service life of the photoreceptor 413 in accordance with the method described with reference to FIG. 7.

In this manner, the service life of the photoreceptor can be predicted with high accuracy.

Although the number of printed sheets per hour is used in the present embodiment, the time interval is not limited thereto, and the calculation may be performed daily, or the like. Further, the film scraping amount may be calculated using the number of rotations of the photoreceptor, a miming distance, the number of printed sheets, an application time of a charging roller, and the like per unit time.

Moreover, although the number of rotations of the photoreceptor with respect to the single-sided printing and the double-sided printing has been counted for measurement, as described above, the number of printed sheets, the running distance, the application time of the charging roller, and an application distance may be measured to calculate the film scraping amount.

Although the case of a device has been described above, the process described above may be executed in cooperation with a remote center communicable with an image forming apparatus 1.

Specifically, the number of rotations of the photoreceptor with respect to the single-sided printing and the double-sided printing, the running distance, the number of printed sheets, the application time of the charging roller, and the like are transmitted to the remote center. Service life determination and service life prediction may be performed in the remote center.

Further, temperature/humidity inside the machine, paper brand information, paper physical property information, image information, and the like may be transmitted to the remote center, variations in the service life prediction may be analyzed from an operation state of the image forming apparatus, and weighting and/or a limit wear amount may be transmitted from the remote center to the image forming apparatus in the similar operation state to correct the service life prediction.

Furthermore, the weighting and the limit wear amount may be transmitted from the remote center depending on the degree of image quality required by a user to perform correction, or the weighting and the limit wear amount may be modified more precisely depending on a region, a season, a company, and a business category.

As a result, parts can be ordered and replaced at an appropriate timing with respect to a plurality of apparatuses, which contributes to labor cost reduction and inventory reduction as well as cost reduction of replacement parts.

(Other Embodiments)

Although the case to be mainly used for the image forming apparatus has been described in the present example, it is not limited to the image forming apparatus, and the method can be used generally for other purposes.

Although embodiments of the present invention have been described and illustrated in detail, the disclosed embodiments are made for purposes of illustration and example only and not limitation. The scope of the present invention should be interpreted by terms of the appended claims, and it is intended to include all modifications in the meanings equivalent to and within the scope of the claims.

What is claimed is:

1. An image forming apparatus, comprising:

a photoreceptor;

a measurer that measures the number of rotations of the photoreceptor for each unit of a predetermined time, wherein the each unit of the predetermined time is a fixed time interval; and a hardware processor that predicts a film scraping amount of the photoreceptor on the basis of a measurement result of the measurer, and determines a service life of the photoreceptor on the basis of a prediction result of the hardware processor, wherein the hardware processor calculates the film scraping amount by multiplying the number of rotations of the photoreceptor per the each unit of the predetermined time by a predetermined coefficient associated with the each unit of the predetermined time, and integrates the calculated film scraping amount for all units of the predetermined time, and the predetermined coefficient is set to a different value according to the number of rotations of the photoreceptor per the each unit of the predetermined time.

2. The image forming apparatus according to claim 1, wherein the predetermined coefficient is set to increase as the number of rotations of the photoreceptor per the each unit of the predetermined time increases.

3. The image forming apparatus according to claim 1, wherein the predetermined coefficient is set to a different value according to the number of rotations of the photoreceptor and the number of jobs per the each unit of the predetermined time.

4. The image forming apparatus according to claim 3, wherein the predetermined coefficient is set to decrease as the number of jobs per the each unit of the predetermined time decreases.

5. The image forming apparatus according to claim 1, wherein the predetermined coefficient is set to a different value according to the number of rotations of the photoreceptor per the each unit of the predetermined time and a thickness or a basis weight of a paper sheet to be printed.

6. The image forming apparatus according to claim 5, wherein the predetermined coefficient is set to increase as the thickness or the basis weight of the paper sheet to be printed increases.

7. The image forming apparatus according to claim 1, wherein the fixed time interval is one day or less.

8. The image forming apparatus according to claim 1, wherein the fixed time interval is one hour or less.

9. A method for controlling an image forming apparatus provided with a photoreceptor, comprising:

measuring the number of rotations of the photoreceptor for each unit of a predetermined time, wherein the each unit of the predetermined time is a fixed time interval;

predicting a film scraping amount of the photoreceptor on the basis of a measurement result; and determining a service life of the photoreceptor on the basis of a prediction result, wherein the predicting includes:

calculating the film scraping amount by multiplying the number of rotations of the photoreceptor per the each unit of the predetermined time by a predetermined coefficient associated with the each unit of the predetermined time; and integrating the calculated film scraping amount for all units of the predetermined time, and the predetermined coefficient is set to a different value according to the number of rotations of the photoreceptor per the each unit of the predetermined time.

10. The method according to claim 9, wherein the fixed time interval is one day or less.

11. The method according to claim 9, wherein the fixed time interval is one hour or less.

12. A non-transitory recording medium storing a computer readable program causing a computer of an image forming apparatus provided with a photoreceptor to perform:

measuring the number of rotations of the photoreceptor for each unit of a predetermined time, wherein the each unit of the predetermined time is a fixed time interval;

predicting a film scraping amount of the photoreceptor on the basis of a measurement result; and determining a service life of the photoreceptor on the basis of a prediction result, wherein the predicting includes:

calculating the film scraping amount by multiplying the number of rotations of the photoreceptor per the each unit of the predetermined time by a predetermined coefficient associated with the each unit of the predetermined time; and integrating the calculated film scraping amount for all units of the predetermined time, and the predetermined coefficient is set to a different value according to the number of rotations of the photoreceptor per the each unit of the predetermined time.

13. The non-transitory recording medium according to claim 12, wherein the fixed time interval is one day or less.

14. The non-transitory recording medium according to claim 12, wherein the fixed time interval is one hour or less.

* * * * *